US006662581B2

(12) United States Patent
Hirota et al.

(10) Patent No.: US 6,662,581 B2
(45) Date of Patent: Dec. 16, 2003

(54) VARIABLE DISPLACEMENT COMPRESSOR AND DISPLACEMENT CONTROL VALVE FOR VARIABLE DISPLACEMENT COMPRESSOR

(75) Inventors: Hisatoshi Hirota, Tokyo (JP); Tomokazu Nakazawa, Tokyo (JP)

(73) Assignee: TGK Co., Ltd., Tokyo (JP)

( * ) Notice: Subject to any disclaimer, the term of this patent is extended or adjusted under 35 U.S.C. 154(b) by 0 days.

(21) Appl. No.: 10/197,970

(22) Filed: Jul. 18, 2002

(65) Prior Publication Data

US 2003/0019226 A1 Jan. 30, 2003

(30) Foreign Application Priority Data

Jul. 25, 2001 (JP) ..... 2001-224209

(51) Int. Cl.[7] ..... F25B 1/00; F04B 1/26
(52) U.S. Cl. ..... 62/228.3; 417/222.2
(58) Field of Search ..... 62/228.3, 228.5; 417/222.2, 222.1, 269, 270, 213; 74/60

(56) References Cited

U.S. PATENT DOCUMENTS 6,267,562 B1 * 7/2001 Hirota ..... 417/222.2
6,449,971 B1 * 9/2002 Kimura et al. ..... 62/228.3
6,481,977 B2 * 11/2002 Mameda et al. ..... 417/222.2
2001/0003573 A1 * 6/2001 Kimura et al. ..... 417/222.2

FOREIGN PATENT DOCUMENTS

JP 06341378 A * 12/1994 ..... F04B/49/00
JP 2001-132650 5/2001

* cited by examiner

*Primary Examiner*—Marc Norman
(74) *Attorney, Agent, or Firm*—Patterson, Thuente, Skaar & Christensen, L.L.C.

(57) ABSTRACT

A displacement control valve that performs transition between operating capacities in a reduced time period. A valve element for introducing refrigerant from a discharge chamber into a pressure-regulating chamber after reducing discharge pressure Pd of the refrigerant to pressure Pc1, and a valve element for introducing refrigerant having pressure Pc2 from the pressure-regulating chamber into a suction chamber under suction pressure Ps are configured to open and close in an interlocked fashion, and a displacement control valve is comprised of the valve elements and a solenoid section that applies to a solenoid force corresponding to a predetermined differential pressure to these valve elements. When control to the minimum operating displacement is carried out, the valve element is fully opened, and the valve element is fully closed, while control to the maximum operating displacement is carried out, the valve element is fully closed, and the valve element is fully opened, whereby transmission between operating capacities is performed in a reduced time period.

19 Claims, 8 Drawing Sheets

VARIABLE DISPLACEMENT COMPRESSOR AND DISPLACEMENT CONTROL VALVE FOR VARIABLE DISPLACEMENT COMPRESSOR

BACKGROUND OF THE INVENTION

1. Field of the Invention

This invention relates to a variable displacement compressor and a displacement control valve for the variable displacement compressor, and more particularly to a variable displacement compressor for compressing a refrigerant gas in a refrigeration cycle for an automotive air conditioner, and a displacement control valve for a variable displacement compressor, for use therein.

2. Description of the Related Art

A compressor used for compressing refrigerant in a refrigeration cycle for an automotive air conditioner is driven by an engine, and hence is not capable of controlling the rotational speed thereof. For this reason, a variable displacement compressor capable of changing the compression displacement for compressing refrigerant is employed so as to obtain adequate refrigerating displacement without being constrained by the rotational speed of the engine.

In the above-mentioned variable displacement compressor, compression pistons are connected to a wobble plate fitted on a shaft driven for rotation by the engine, and the angle of the wobble plate is changed to change the length of piston stroke for changing the delivery quantity of the compressor.

The angle of the wobble plate is continuously changed by introducing part of the compressed refrigerant into a gastight pressure-regulating chamber and changing the pressure of the introduced refrigerant, thereby changing a balance between pressures applied to the opposite sides of each piston.

A compression displacement control device disclosed e.g. in Japanese Laid-Open Patent Publication (Kokai) No. 2001-132650 has a solenoid control valve arranged between a discharge port and a pressure-regulating chamber of a compressor or between the discharge port and a suction port of the same. This solenoid control valve opens and closes the communication such that a differential pressure across the solenoid control valve is maintained at a predetermined value. The predetermined value of the differential pressure can be set from outside by a current value. As a result, when the engine rotational speed increases, the pressure introduced into the pressure-regulating chamber is increased to reduce the displacement for compression, and when the engine rotational speed decreases, the pressure introduced into the pressure-regulating chamber is reduced to increase the displacement for compression, whereby the pressure of refrigerant discharged from the compressor is maintained at a constant level.

Although refrigerant generally used in a refrigeration cycle of an automotive air conditioner is a chlorofluorocarbon alternative HFC-134a, there has recently been developed a refrigeration cycle which causes the refrigerant to perform refrigeration in a supercritical region where the temperature of the refrigerant is above its critical temperature, e.g. a refrigeration cycle using carbon dioxide as refrigerant In the conventional solenoid control valve for the compression displacement control device, to minimize operating displacement of the variable displacement compressor, it is required to maximize the amount of refrigerant introduced into the pressure-regulating chamber, but if the size of the valve is small, the amount of refrigerant introduced is small, and hence transition to a minimum displacement operation takes time, which can degrade controllability of the compressor.

On the other hand, when the size of the valve is increased so as to increase the amount of refrigerant introduced, the pressure-receiving area of the valve is also increased, and hence a large solenoid force is required to control the valve. Particularly in the refrigeration cycle using carbon dioxide as the refrigerant, since the pressure of refrigerant is increased to the supercritical region, the discharge pressure of the refrigerant becomes very high, so that the solenoid force for controlling the valve is also increased. This requires a huge solenoid, which causes an increase in the size of the solenoid valve and a resultant increase in manufacturing costs.

SUMMARY OF THE INVENTION

The present invention has been made in view of the above circumstances, and an object thereof is to provide a variable displacement compressor and a displacement control valve for the variable displacement compressor which are capable of performing transition between operating capacities in a reduced time period and operating without using a large solenoid force even when the size of the valve is increased so as to increase the amount of refrigerant.

In order to accomplish the above object, a variable displacement compressor including a wobble member arranged in a pressure-regulating chamber formed airtightly, such that an inclination angle of the wobble member can be changed with respect to a rotational shaft, and driven by rotation of the rotational shaft for wobbling motion, and pistons each connected to the wobble member for performing reciprocating motion in a direction parallel to the rotational shaft in accordance with the wobbling motion of the wobble member, to thereby draw refrigerant from a suction chamber into a cylinder, compress the refrigerant, and deliver the compressed refrigerant from the cylinder to a discharge chamber is provided. The variable displacement compressor is characterized in that a flow rate of the refrigerant flowing in a first refrigerant passage extending from the discharge chamber to the pressure-regulating chamber and a flow rate of the refrigerant flowing in a second refrigerant passage extending from the pressure-regulating chamber to the suction chamber are controlled in an interlocked fashion such that the first refrigerant passage and the second refrigerant passage are opened and closed, based on a change in a differential pressure between pressure in the suction chamber and pressure in the discharge chamber.

In addition, in order to accomplish the above object a displacement control valve for a variable displacement compressor, for controlling an amount of refrigerant introduced from a discharge chamber into a pressure-regulating chamber, such that a differential pressure between pressure in the suction chamber and pressure in the discharge chamber are maintained at a predetermined differential pressure, to thereby change an amount of the refrigerant discharged from the variable displacement compressor is provided. The displacement control valve for a variable displacement compressor is characterized by comprising the steps of: (a) first and second valve elements operated in an interlocked fashion for opening and closing a refrigerant passage extending between the discharge chamber and the pressure-regulating chamber and a refrigerant passage extending between the pressure-regulating chamber and the suction chamber, respectively; (b) a solenoid section for applying a solenoid force corresponding to the predetermined differential pressure to the first and second valve elements.

The above and other objects, features and advantages of the present invention will become apparent from the following description when taken in conjunction with the accompanying drawings which illustrate preferred embodiments of the present invention by way of example.

DESCRIPTION OF THE PREFERRED EMBODIMENTS

Hereinafter, embodiments of the present invention will be described in detail with reference to the drawings.

Figure 1:
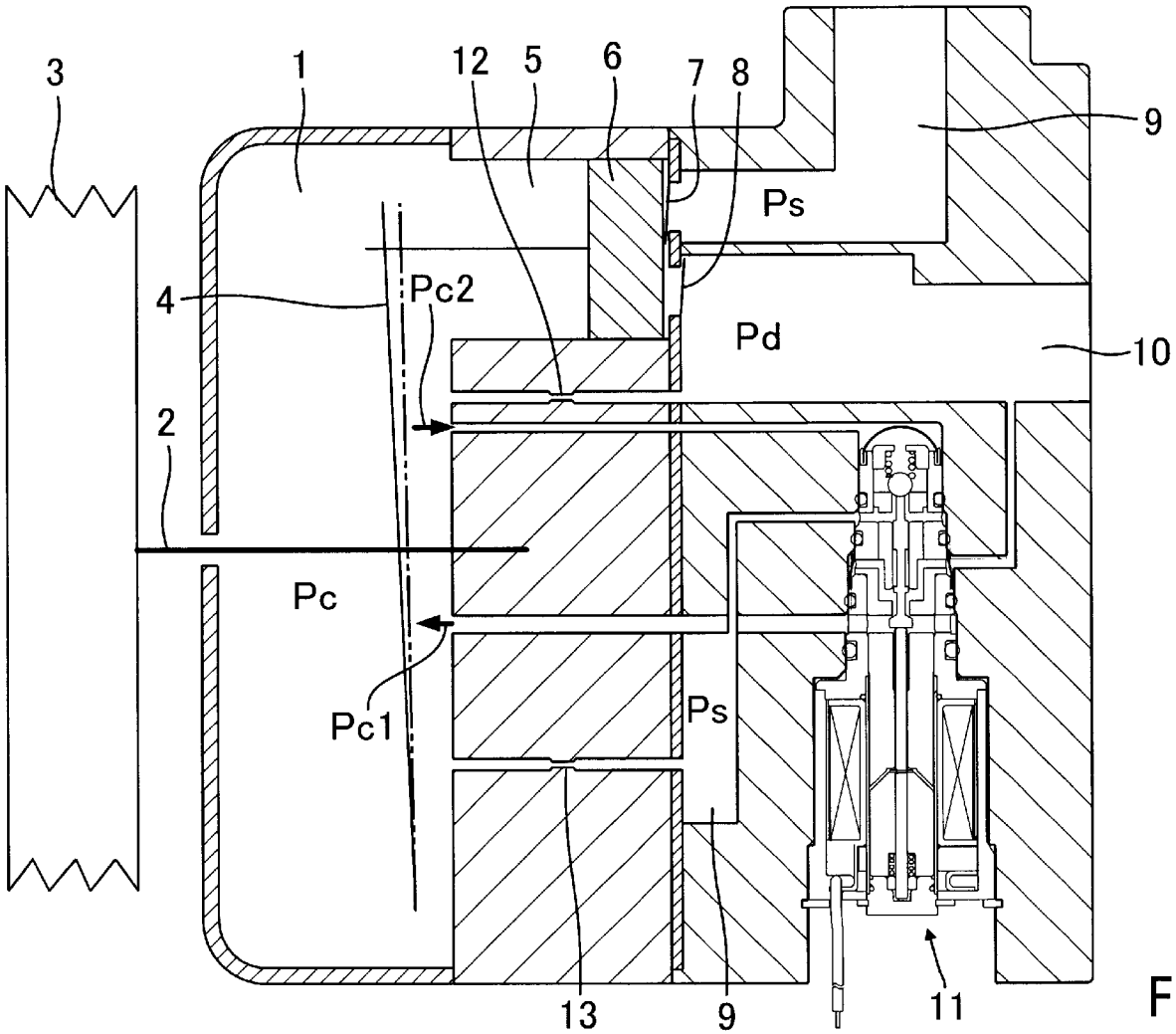
FIG. 1 is a cross-sectional view schematically showing a variable displacement compressor to which is applied a displacement control valve according to the invention.

FIG. 1 is a cross-sectional view schematically showing a variable displacement compressor to which is applied a displacement control valve according to the invention.

The variable displacement compressor includes a pressure-regulating chamber 1 formed airtightly and a rotational shaft 2 rotatably supported in the pressure-regulating chamber 1. The rotational shaft 2 has one end extending outward from the pressure-regulating chamber 1 via a shaft sealing device, not shown, and having a pulley 3 fixed thereto which receives transmission of a driving force from an output shaft of an engine via a clutch and a belt. A wobble plate 4 is fitted on the rotational shaft 2 such that the inclination angle of the wobble plate 4 can be changed. A plurality of cylinders 5 (only one of which is shown in the figure) are arranged around the axis of the rotational shaft 2. In each cylinder 5, there is arranged a piston 6 for converting rotating motion of the wobble plate 4 to reciprocating motion. Each of the cylinders 5 is connected to a suction chamber 9 and a discharge chamber 10 via a suction relief valve 7 and a discharge relief valve 8, respectively. The respective suction chambers 9 associated with the cylinders 5 communicate with each other to form one chamber which is connected to an evaporator of a refrigeration cycle. Similarly, the respective discharge chambers 10 associated with the cylinders 5 communicate with each other to form one chamber which is connected to a gas cooler or a condenser of the refrigeration cycle.

Further, in the variable displacement compressor, a displacement control valve 11 comprised of two valves is arranged at an intermediate portion of a refrigerant passage extending from the discharge chamber 10 to the pressure-regulating chamber 1 and in a refrigerant passage for communication between the pressure-regulating chamber 1 and the suction chamber 9. There are formed orifices 12, 13 between the discharge chamber 10 and the pressure-regulating chamber 1 and between the pressure-regulating chamber 1 and the suction chamber 9, respectively. It should be noted that although the orifices 12, 13 are formed in the body of the variable displacement compressor, they may be formed in the displacement control valve 11.

In the variable displacement compressor constructed as above, as the rotational shaft 2 is rotated by the driving force of the engine, the wobble plat 4 fitted on the rotational shaft 2 rotates, which causes reciprocating motion of each piston 6 connected to the wobble plate 4. As a result, refrigerant within the suction chamber 9 is drawn into a cylinder 5, and compressed therein, and then the compressed refrigerant is delivered to the discharge chamber 10.

At this time, during normal operation, responsive to a discharge pressure Pd of the refrigerant within the discharge chamber 10, the displacement control valve 11 controls the amount of refrigerant introduced into the pressure-regulating chamber 1 (the pressure in the pressure-regulating chamber 1 at the time is represented by Pc1) and the amount of refrigerant introduced from the pressure-regulating chamber 1 into the suction chamber 9 (the pressure in the pressure-regulating chamber 1 at the time is represented by Pc2) in an interlocking fashion such that the differential pressure between the discharge pressure Pd and a suction pressure Ps is maintained at a predetermined differential pressure. As a result, the pressure Pc (=Pc1=Pc2) in the pressure-regulating chamber 1 is held at a predetermined value, and the displacement of the cylinder 5 is controlled to a predetermined value.

When transition to the minimum displacement operation is performed, the displacement control valve 11 fully opens one valve thereof provided for introducing refrigerant from the discharge chamber 10 into the pressure-regulating chamber 1 and fully closes the other valve thereof provided for introducing refrigerant from the pressure-regulating chamber 1 into the suction chamber 9, thereby shortening time for increasing the pressure Pc (=Pc1) in the pressure-regulating chamber 1. It should be noted that although the displacement control valve 11 fully closes the refrigerant passage extending from the pressure-regulating chamber 1 to the suction chamber 9 during the time period, there remains a flow of refrigerant at a minute flow rate via the orifice 13.

For a maximum displacement operation of the compressor, the displacement control valve 11 fully closes the one valve thereof provided for introducing refrigerant from the discharge chamber 10 into the pressure-regulating chamber 1 and fully opens the other valve thereof provided for introducing refrigerant from the pressure-regulating chamber 1 into the suction chamber 9, so as to maximize the amount of refrigerant introduced from the pressure-regulating chamber 1 into the suction chamber 9, thereby shortening time for reducing the pressure Pc (=Pc2) in the pressure-regulating chamber 1. It should be noted that although the displacement control valve 11 fully closes the refrigerant passage extending from the discharge chamber 10 to the pressure-regulating chamber 1 during the time period, refrigerant is introduced into the pressure-regulating chamber 1 via the orifice 12, whereby lubricating oil mixed into the refrigerant is supplied to the pressure-regulating chamber 1.

Next, the displacement control valve 11 according to the invention will be described in detail.

Figure 2:
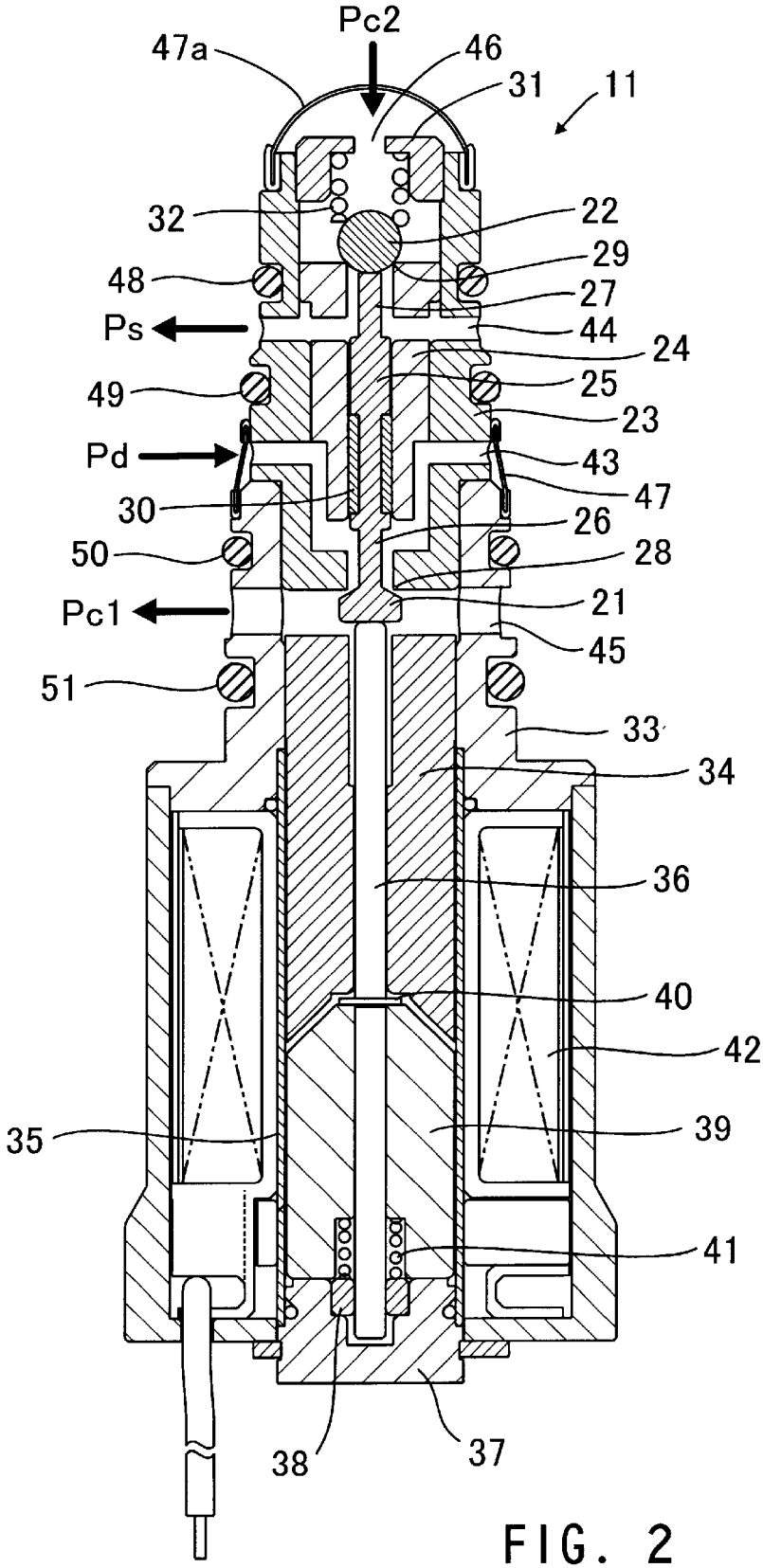
FIG. 2 is a central longitudinal cross-sectional view of the displacement control valve according to a first embodiment.

FIG. 2 is a central longitudinal cross-sectional view of the displacement control valve according to a first embodiment.

The displacement control valve 11 is comprised of two valve elements 21, 22 integrally formed such that they are operated in an interlocked fashion. More specifically, a central shaft 25 axially movably held by a holder 24 fitted in a central opening portion of a body 23, thin shafts 26, 27 formed to have a smaller thickness than the central shaft 25 and extending from the opposite ends of the same, and the valve element 21 positioned at a location downward of the thin shaft 26, as viewed in the figure, are integrally formed with each other, and the other valve element 22 is arranged in abutment with the upper thin shaft 27. The central shaft 25 held by the holder 24 has a pressure-receiving area smaller than respective effective pressure-receiving areas of the valve elements 21, 22 and forms a pressure-sensing portion. Further, the central shaft 25 is formed with a portion with a reduced diameter, on which a packing 30 formed e.g. of polytetrafluoroethylene is fitted.

A valve seat 28 for the valve element 21 is formed by the lower end, as viewed in the figure, of the body 23 holding the holder 24. The valve seat 28 has a valve hole whose inner diameter is slightly larger than that of a portion of the holder 24 holding the central shaft 25.

A valve seat 29 for the valve element 22 is formed by the upper end, as viewed in the figure, of the holder 24. The valve seat 29 has a valve hole whose inner diameter is slightly larger than that of the portion of the holder 24 holding the central shaft 25. The valve element 22 is urged in a valve-closing direction by a spring 32 arranged between a spring-receiving member 31 fitted in the upper opening end, as viewed in the figure, of the body 23 and the valve element 22 itself.

The body 23 is fitted in an upper opening of a body 33. The body 33 has a central opening portion in which are fixedly fitted respective upper ends of a fixed core 34 and a sleeve 35 of a solenoid section. The fixed core 34 has a central opening portion forming a guide for axially slidably holding a shaft 36 of the solenoid section. The lower end of the shaft 36 is axially slidably held by a guide 38 arranged in a stopper 37 closing the lower end of the sleeve 35, and a movable core 39 of the solenoid section is fitted on the lower portion of the shaft 36. The movable core 39 has an upper end thereof held in abutment with a stopper ring 40 fitted on the shaft 36, and is urged upward, as viewed in the figure, by a spring 41 arranged between the guide 38 and the movable core 39 itself. Further, the sleeve 35 is surrounded by a solenoid coil 42.

The body 23 has a hole communicating with a central space through which the thin shaft 26 extends, and the hole forms a port 43 for receiving the discharge pressure Pd from the discharge chamber 10. A strainer 47 is mounted on the outer edge of the port 43. Further, the body 23 has a hole communicating with a central space through which the thin shaft 27 extends, and the hole forms a port 44 for receiving the suction pressure Ps from the suction chamber 9. The body 33 has a hole communicating with a space in which the valve element 21 is arranged, and the hole forms a port 45 for introducing the pressure Pc1 into the pressure-regulating chamber 1. The spring-receiving member 31 has a hole communicating with a space in which the valve element 22 is arranged, and the hole forms a port 46 for introducing the pressure Pc2 from the pressure-regulating chamber 1. A strainer 47*a* is mounted on a distal end of the body 23.

The body 23 has O rings 48, 49 fitted thereon at respective locations upward and downward of the port 44, while the body 33 has O rings 50, 51 fitted thereon at respective locations upward and downward of the port 45.

Now, the relationship of pressures in the displacement control valve 11 will be described. First, the discharge pressure Pd received from the discharge chamber 10 via the port 43 acts on the central shaft 25 and the valve element 21 in the opposite directions of the axis. When the effective pressure-receiving area of the valve element 21 is represented by A, and that of the central shaft 25 by B, a force of Pd·A acts downward, as viewed in the figure, on the valve element 21, while a force of Pd·B acts upward, as viewed in the figure, on the central shaft 25. Between the effective pressure-receiving area A of the valve element 21 and the effective pressure-receiving area B of the central shaft 25, A>B holds, and hence, after all, a force of Pd (A−B) acts on the valve element 21 and the central shaft 25 in the downward direction, as viewed in the figure, for opening the valve. The difference (A−B) corresponds to the effective pressure-receiving area of the conventional valve element, and conventionally, the flow rate of refrigerant is limited by the effective pressure-receiving area. According to the present invention, however, although the valve element 21 has the large effective pressure-receiving area A which can allow an increased amount of refrigerant to flow, the force acting on the valve element 21 in the valve-opening direction is limited to the small force Pd (A−B). Further, since the pressures Pc1, Pc2 (Pc1=Pc2) in the pressure-regulating chamber 1 are axially applied to the valve elements 21, 22 from the respective opposite sides via the respective ports 45, 46, the influence of the pressure Pc upon the valve element 21 is canceled. Thus, the central shaft 25 having a different pressure-receiving area from that of the valve element 21 is integrally formed with the valve element 21, and this makes it possible to form a valve having a small pressure-receiving area of (A−B), irrespective of the valve size.

Similarly, a force of Ps (A−B) acts on the valve element 22 and the central shaft 25 in the valve-opening direction, and the pressures Pc1, Pc2 (Pc1=Pc2) in the pressure-regulating chamber 1 are axially applied to the valve elements 21, 22 integral with each other from the respective opposite sides, which cancels the influence of the pressure Pc upon the valve element 22. It should be noted that the ratio between the effective pressure-receiving area of the valve element 22 and that of the central shaft 25 is configured to be equal to the ratio between the effective pressure-receiving area of the valve element 21 and that of the central shaft 25. Therefore, the valve elements 21, 22 form a differential pressure valve which operates in response to a differential pressure between the discharge pressure Pd and the suction pressure Ps.

Further, the pressure Pc1 received via the port 45 is supplied to a gap between the sleeve 35 and the movable core 39 as well as to a gap between the movable core 39 and the stopper 37 via a clearance between the fixed core 34 and the shaft 36. In short, the inside of the solenoid section is filled with the pressure Pc1.

In the displacement control valve 11 having two valve structures interlocked as described above, when no control current is supplied to the solenoid coil 42 of the solenoid section, as shown in FIG. 2, the valve element 21 between the discharge pressure Pd and the pressure Pc1 from the pressure-regulating chamber 1 is fully open, whereas the valve element 22 between the pressure Pc2 and the suction pressure Ps is fully closed. Further, the movable core 39 of the solenoid section is held away from the fixed core 34 due to a balance between spring load of the spring 32 and that of the spring 41. Therefore, the value of the pressure Pc1 in the pressure-regulating chamber 1 is held close to that of the discharge pressure Pd, and hence the difference between pressures applied to the opposite faces of the piston 6 is minimized, whereby the wobble plate 4 is inclined at an inclination angle which minimizes the length of stroke of the piston 6, thus controlling the variable displacement compressor to the minimum displacement operation.

When a maximum control current is supplied to the solenoid coil 42 of the solenoid section, the movable core 39 is attracted toward the fixed core 34 and moved upward, as viewed in the figure, whereby the valve element 21 between the discharge pressure Pd and the pressure Pc1 from the pressure-regulating chamber 1 is fully closed, and the valve element 22 between the pressure Pc2 and the suction pressure Ps is fully opened. As a result, in addition to refrigerant being introduced from the pressure-regulating chamber 1 into the suction chamber 9 via the orifice 13, refrigerant flows from the port 46 communicated with the pressure-regulating chamber 1, and passes between the valve element 22 and the valve seat 29 therefor, followed by being introduced into the suction chamber 9 via the port 44. Since the amount of refrigerant introduced from the pressure-regulating chamber 1 into the suction chamber 9 is increased, it is possible to increase a speed at which the operating displacement is maximized.

During execution of normal control in which a predetermined control current is supplied to the solenoid coil 42 of the solenoid section, the movable core 39 is attracted toward the fixed core 34 and moved upward, as viewed in the figure, according to the magnitude of the control current. As a result, the valve element 22 is opened from its closed state only when the differential pressure between the discharge pressure Pd and the suction pressure Ps exceeds a predetermined reference value. In short, during execution of the normal control, the displacement control valve 11 operates as a differential pressure valve.

Figure 3:
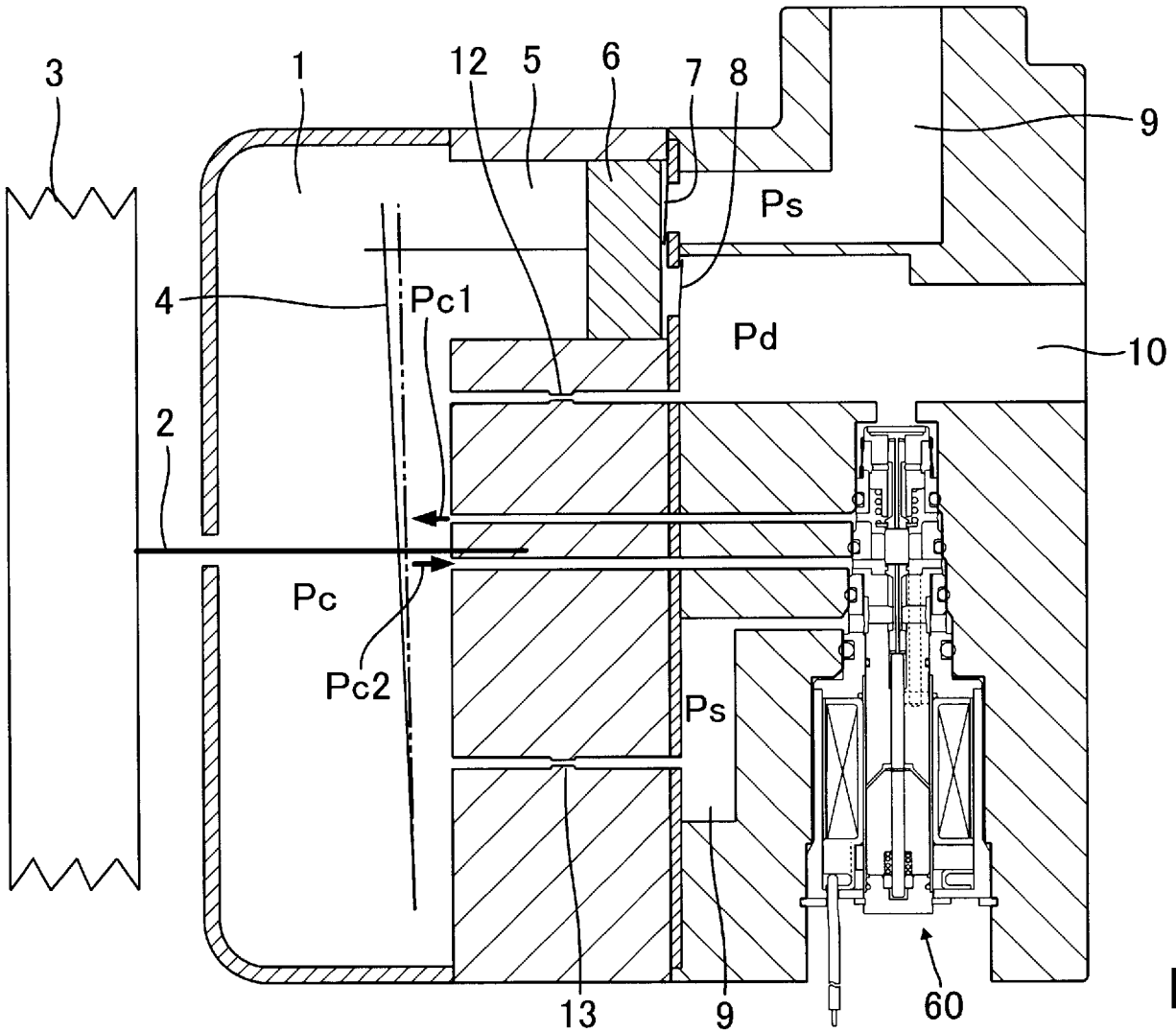
FIG. 3 is a cross-sectional view schematically showing a variable displacement compressor to which is applied another displacement control valve according to the invention.

FIG. 3 is a cross-sectional view schematically showing a variable displacement compressor to which is applied another displacement control valve according to the present invention. In FIG. 3, component parts and elements similar to those appearing in FIG. 1 are designated by identical reference numerals, and detailed description thereof is omitted.

In the variable displacement compressor, a displacement control valve 60 comprised of two valves is arranged at an intermediate portion of a refrigerant passage extending from a discharge chamber 10 to a pressure-regulating chamber 1 and in a refrigerant passage for communication between the pressure-regulating chamber 1 and a suction chamber 9. Further, there are formed orifices 12, 13 between the discharge chambers 10 and the pressure-regulating chamber 1 and between the pressure-regulating chamber 1 and the suction chamber 9, respectively.

In the variable displacement compressor constructed as above, as a rotational shaft 2 is rotated by the driving force of an engine, a wobble plate fitted on the rotational shaft 2 rotates, which causes reciprocating motion of each piston 6 connected to the wobble plate 4. This causes refrigerant within the suction chamber 9 to be drawn into a cylinder 5 and compressed therein, and then the compressed refrigerant is delivered to the discharge chamber 10.

At this time, during normal operation, responsive to a discharge pressure Pd of the refrigerant within the discharge chamber 10, the displacement control valve 60 controls the amount of refrigerant introduced into the pressure-regulating chamber 1 (the pressure in the pressure-regulating chamber 1 at the time is represented by Pc1) and the amount of refrigerant introduced from the pressure-regulating chamber 1 into the suction chamber 9 (the pressure in the pressure-regulating chamber 1 at the time is represented by Pc2) in an interlocking fashion such that the differential pressure between the discharge pressure Pd and a suction pressure Ps is maintained at a predetermined differential pressure. As a result, the pressure Pc (=Pc1=Pc2) in the pressure-regulating chamber 1 is held at a predetermined value, and the displacement of the cylinder 5 is controlled to a predetermined value.

When transition to the minimum displacement operation is performed, the displacement control valve 60 fully opens one valve thereof provided for introducing refrigerant from the discharge chamber 10 into the pressure-regulating chamber 1 and fully closes the other valve thereof provided for introducing refrigerant from the pressure-regulating chamber 1 into the suction chamber 9, thereby shortening time for increasing the pressure Pc (=Pc1) in the pressure-regulating chamber 1.

For a maximum displacement operation of the compressor, the displacement control valve 60 fully closes the one valve thereof provided for introducing refrigerant from the discharge chamber 10 into the pressure-regulating chamber 1 and fully opens the other valve thereof provided for introducing refrigerant from the pressure-regulating chamber 1 into the suction chamber 9, so as to maximize the amount of refrigerant introduced from the pressure-regulating chamber 1 into the suction chamber 9, thereby shortening time for reducing the pressure Pc (=Pc2) in the pressure-regulating chamber 1.

Next, the displacement control valve 60 for executing the above control will be described in detail.

Figure 4:
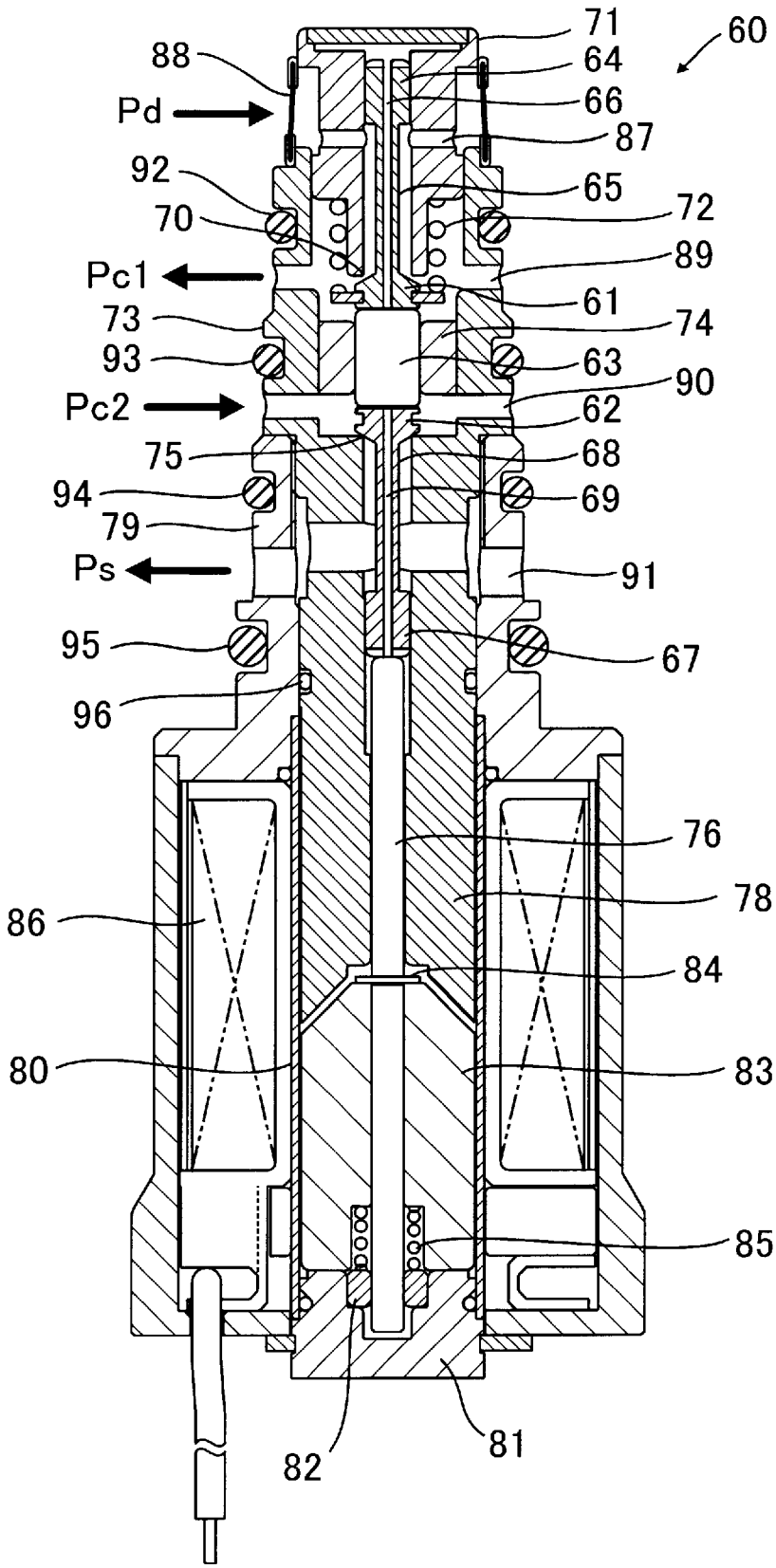
FIG. 4 is a central longitudinal cross-sectional view of the displacement control valve according to a second embodiment.

FIG. 4 is a central longitudinal cross-sectional view of the displacement control valve according to a second embodiment.

In the displacement control valve 60, the two valve elements 61, 62 are opposed to each other via a transmission shaft 63 on an identical axis such that they can move along the axis. The valve element 61 arranged at an upper location, as viewed in the figure, is integrally formed with a piston 64 forming a pressure-sensing portion and a shaft 65 connecting between the valve element 61 and the piston 64. Further, the one-piece member formed by the valve element 61, the shaft 65 and the piston 64 is formed therethrough with a communication hole 66 extending along the axis thereof. Similarly, the valve element 62 arranged at a lower location, as viewed in the figure, is integrally formed with a piston 67 forming a pressure-sensing portion and a shaft 68 connecting between the valve element 62 and the piston 67. Further, the one-piece member formed by the valve element 62, the shaft 68 and the piston 67 is formed therethrough with a communication hole 69 extending along the axis thereof. Each of the valve elements 61, 62 has an end face thereof in abutment with the transmission shaft 63, and the end face is formed with a step for allowing communication between the communication hole 66 (69) and a space where the valve element 61 (62) is located, even in the abutted state.

A valve seat 70 for the valve element 61 is formed by the lower end, as viewed in the figure, of a body 71 axially slidably holding the piston 64. The valve seat 70 has an inner diameter which is slightly larger than the inner diameter of a cylinder holding the piston 64. The valve element 61 is urged in the valve-opening direction by a spring 72.

The body 71 is fitted in an upper opening of a body 73. The body 73 is formed with a hole extending downward from the upper opening, the hole having four stepwise sequentially reduced-diameter portions. A first reduced-diameter portion has a holder 74 fitted therein for axially movably holding the transmission shaft 63, and an edge of opening formed in a step to a next reduced-diameter portion forms a valve seat 75 for the valve element 62. A next reduced-diameter portion forms a cylinder for axially slidably holding the piston 67, and a next reduced-diameter portion forms a guide for axially slidably holding a shaft 76 of a solenoid section. Further, the lower portion of the body 73 forms a fixed core 78 of the solenoid section.

The body 73 is screwed in an upper opening of a body 79. The upper end of a sleeve 80 is fixed to a lower opening of the body 79. The sleeve 80 has a lower end thereof closed by a stopper 81. Within the sleeve 80, the lower end of the shaft 76 is axially slidably held by a guide 82 provided in the stopper 81. A movable core 83 is fitted on the lower portion of the shaft 76. The movable core 83 has an upper end thereof held in abutment with a stopper ring 84 fitted on the shaft 76, and is urged upward, as viewed in the figure, by a spring 85 arranged between the guide 82 and the movable core 83 itself. Further, the outer periphery of the sleeve 80 is surrounded by a solenoid coil 86.

The body 71 has a hole communicating with a central space through which the shaft 65 extends, and the hole forms a port 87 for receiving the discharge pressure Pd from the discharge chamber 10. A strainer 88 is mounted on the port 87. The body 73 has a hole communicating with a space in which the valve element 61 is located, and the hole forms a port 89 for introducing the pressure Pc1 into the pressure-regulating chamber 1. The body 73 also has a hole communicating with a space in which the valve element 62 is located, and the hole forms a port 90 for introducing the pressure Pc2 from the pressure-regulating chamber 1. Further, the body 73 is formed with a hole for communication with a central space through which the shaft 68 extends, and the body 79 is formed with a hole such that this hole communicates with the hole of the body 73, whereby the two holes form a port 91 communicating with the suction chamber 9 under the suction pressure Ps.

The body 73 has O rings 92, 93 fitted thereon at respective locations upward and downward of the port 89, while the body 79 has O rings 94, 95 fitted thereon at respective locations upward and downward of the port 91. Further, portions of the body 73 and the body 79 in contact with each other, closer to the solenoid section with respect to the port 91, are sealed by an O ring 96.

Now, the relationship of pressures in the displacement control valve 60 will be described. First, the discharge pressure Pd received from the discharge chamber 10 via the port 87 is applied to the piston 64 and the valve element 61 in the opposite directions of the axis. When the effective pressure-receiving area of the valve element 61 is represented by A, and that of the piston 64 by B, a force of Pd·A acts downward, as viewed in the figure, on the valve element 61, while a force of Pd·B acts upward, as viewed in the figure, on the piston 64. Between the effective pressure-receiving area A of the valve element 61 and the effective pressure-receiving area B of the piston 64, A>B holds, and hence, after all, a force of Pd (A−B) acts on the valve element 61 and the piston 64 in the downward direction, as viewed in the figure, for opening the valve. The difference (A−B) corresponds to the effective pressure-receiving area of the conventional valve element, and conventionally, the flow rate of refrigerant is limited by the effective pressure-receiving area. According to the present invention, however, although the valve element 61 has the large effective pressure-receiving area A which can allow an increased amount of refrigerant to flow, the force acting on the valve element 61 in the valve-opening direction is limited to the small force Pd (A−B). Furthermore, the pressure Pc1 received via the port 89 is also applied to a back pressure chamber-side face of the piston 64 via the central communication hole 66, so that the influence of the pressure Pc1 upon the valve element 61 is canceled. Thus, the piston 64 having a different pressure-receiving area from that of the valve element 61 is integrally formed with the valve element 61, which makes it possible to form a valve having a small pressure-receiving area, irrespective of the valve size.

Similarly, a force of Ps (A−B) acts on the valve element 62 and the piston 67 in the valve-opening direction, and the pressure Pc2 received via the port 90 is also applied to a back pressure chamber-side face of the piston 67 via the central communication hole 69, so that the influence of the pressure Pc2 upon the valve element 62 is canceled. It should be noted that the ratio between the effective pressure-receiving area of the valve element 62 and that of the piston 67 is configured to be equal to the ratio between the effective pressure-receiving area of the valve element 61 and that of the piston 64. Therefore, the valve elements 61, 62 in opposed arrangement form a differential pressure valve which operates in response to a differential pressure between the discharge pressure Pd and the suction pressure Ps.

Further, the pressure Pc2 received via the port 90 is supplied via the communication hole 69 to a space forming the back-pressure chamber of the piston 67, a clearance between the fixed core 78 and the shaft 76, a space between the fixed core 78 and the movable core 83, a clearance between the sleeve 80 and the movable core 83, and a clearance between the movable core 83 and the stopper 81, and hence the internal part of the displacement control valve 60 closer to the solenoid section with respect to the O ring 96 is filled with the pressure Pc2 (=Pc).

In the displacement control valve 60 having the two valve structures interlocked as described above, when no control current is supplied to the solenoid coil 86 of the solenoid section, as shown in FIG. 4, the valve element 61 between the discharge pressure Pd and the pressure Pc1 from the pressure-regulating chamber 1 is fully open, whereas the valve element 62 between the pressure Pc2 and the suction pressure Ps is fully closed. Further, the movable core 83 of the solenoid section is held away from the fixed core 78 due to a balance between spring load of the spring 72 and that of the spring 85. Therefore, the value of the pressure Pc1 in the pressure-regulating chamber 1 is held close to the value of the discharge pressure Pd, and hence the difference between pressures applied to the respective opposite faces of the piston 6 is minimized, whereby the wobble plate 4 is inclined at an inclination angle which minimizes the length of stroke of the piston 6, thus controlling the variable displacement compressor to the minimum displacement operation.

When a maximum control current is supplied to the solenoid coil 86 of the solenoid section, the movable core 83 is attracted toward the fixed core 78 and moved upward, as viewed in the figure, whereby the valve element 61 between the discharge pressure Pd and the pressure Pc1 from the pressure-regulating chamber 1 is fully closed, and the valve element 62 between the pressure Pc2 and the suction pressure Ps is fully opened. As a result, in addition to refrigerant being introduced from the pressure-regulating chamber 1 into the suction chamber 9 via the orifice 13, refrigerant flows from the port 90 communicated with the pressure-regulating chamber 1, and passes between the valve element 62 and the valve seat 75 therefor, followed by being introduced into the suction chamber 9 via the port 91. Since the amount of refrigerant introduced from the pressure-regulating chamber 1 into the suction chamber 9 is increased, it is possible to increase a speed at which the operating displacement is maximized.

During execution of normal control in which a predetermined control current is supplied to the solenoid coil 86 of the solenoid section, the movable core 83 is attracted toward the fixed core 78 and moved upward, as viewed in the figure, according to the magnitude of the control current. As a result, the valve element 62 is opened from its closed state only when the differential pressure between the discharge pressure Pd and the suction pressure Ps exceeds a predetermined reference value. In short, during execution of the normal control, the displacement control valve 60 operates as a differential pressure valve.

Figure 5:
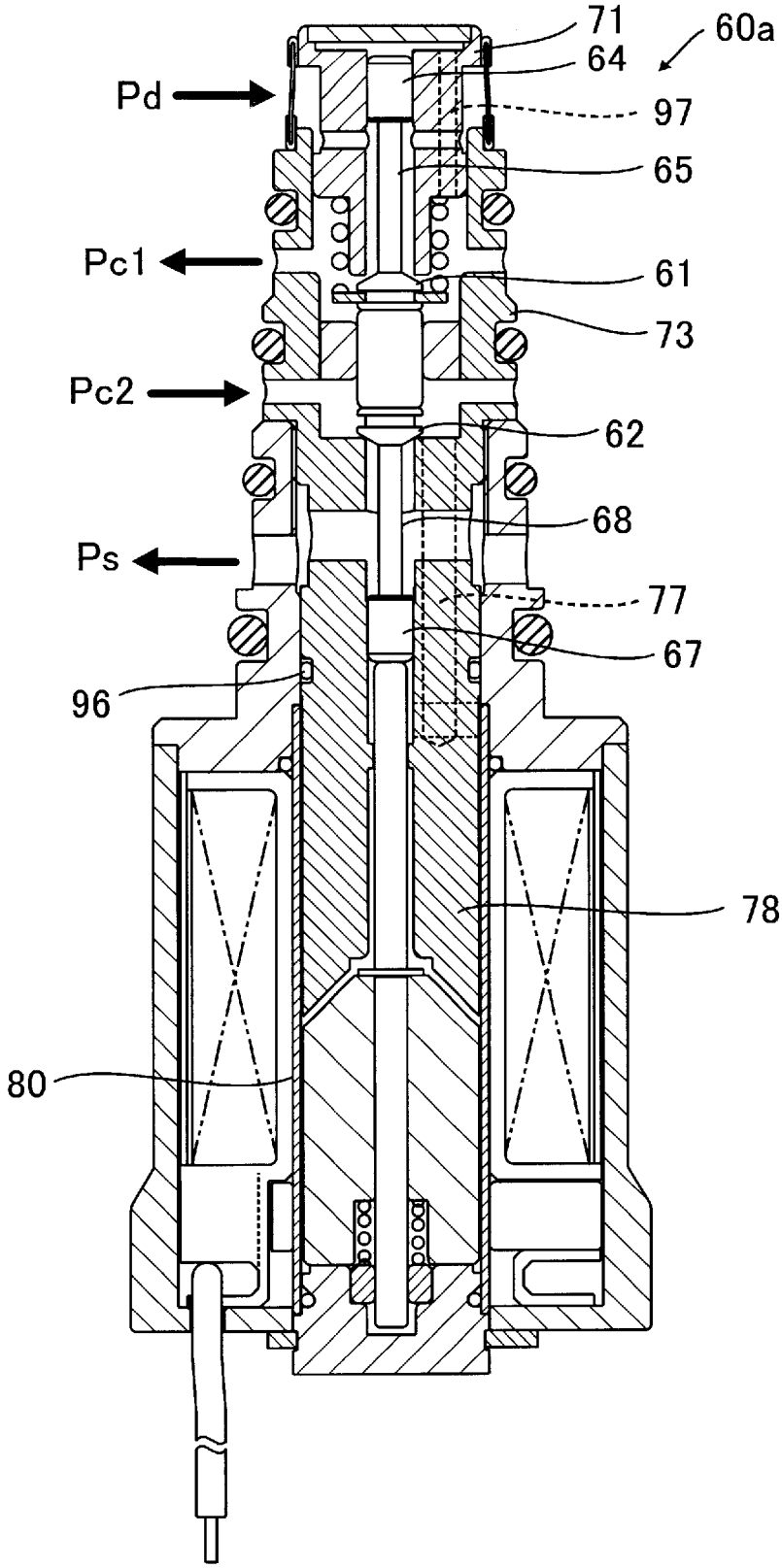
FIG. 5 is a central longitudinal cross-sectional view of a displacement control valve according to a third embodiment.

FIG. 5 is a central longitudinal cross-sectional view of a displacement control valve according to a third embodiment. In FIG. 5, component parts and elements similar to those appearing in FIG. 4 are designated by identical reference numerals, and detailed description thereof is omitted.

The displacement control valve 60*a* according to the third embodiment has a different structure for canceling the influences of the pressures Pc1, Pc2 upon respective valve elements 61, 62, from that of the FIG. 4 displacement control valve 60 shown in FIG. 4. More specifically, a one-piece member formed by the valve element 61, a piston 64, and a shaft 65, and a one-piece member formed by the valve element 62, a piston 67, and a shaft 68 are each formed as a solid member having no communication hole axially extending therethrough. On the other hand, a body 71 is formed with a communication hole 97 for introducing the pressure Pc1 into a back pressure chamber of the piston 64. Further, a body 73 is formed with a communication hole 77 opening into a space forming a back pressure chamber of the piston 67 and a clearance between respective portions of a fixed core 78 and a sleeve 80 closer the solenoid section with respect to an O ring 96. The displacement control valve 60*a* constructed as above operates similarly to the displacement control valve 60 of the second embodiment.

Figure 6:
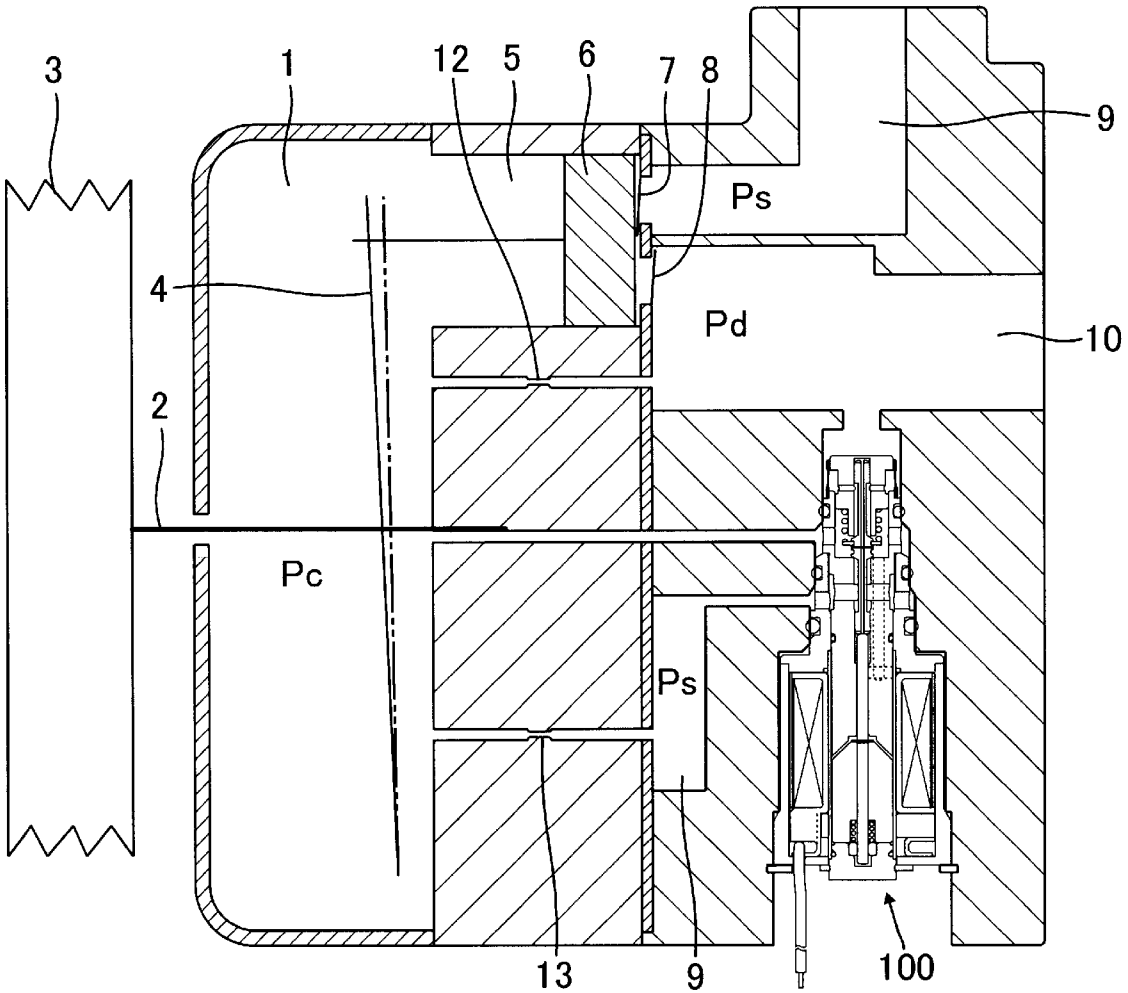
FIG. 6 is a cross-sectional view schematically showing a variable displacement compressor to which is applied still another displacement control valve according to the invention.

FIG. 6 is a cross-sectional view schematically showing a variable displacement compressor to which is applied still another displacement control valve according to the present invention. In FIG. 6, component parts and elements similar to those appearing in FIGS. 1 and 3 are designated by identical reference numerals, and detailed description thereof is omitted.

In the variable displacement compressor, a displacement control valve 100 comprised of two valves is arranged at an intermediate portion of a refrigerant passage extending from a discharge chamber 10 to a pressure-regulating chamber 1 and in a refrigerant passage for communication between the pressure-regulating chamber 1 and a suction chamber 9. The two refrigerant passages share the portion between the displacement control valve 100 and the pressure-regulating chamber 1.

In the variable displacement compressor constructed as above, as the rotational shaft 2 is rotated by the driving force of the engine, the wobble plate fitted on the rotational shaft 2 rotates, which causes reciprocating motion of each piston 6 connected to the wobble plate 4. As a result, refrigerant within the suction chamber 9 is drawn into a cylinder 5 and compressed therein, and then the compressed refrigerant is delivered to the discharge chamber 10.

At this time, during normal operation, responsive to discharge pressure Pd of the refrigerant within the discharge chamber 10, the displacement control valve 100 controls the amount of refrigerant introduced into the pressure-regulating chamber 1 and the amount of refrigerant which is part of refrigerant to be introduced into the pressure-regulating chamber 1 but supplied into the suction chamber 9 in a bypassing member, such that the differential pressure between the discharge pressure Pd and a suction pressure Ps is maintained at a predetermined differential pressure. As a result, the pressure Pc in the pressure-regulating chamber 1 is held at a predetermined value, and the displacement of the cylinder 5 is controlled to a predetermined value. Thereafter, the pressure Pc in the pressure-regulating chamber 1 is returned to the suction chamber 9 via an orifice 13.

When transition to the minimum displacement operation is performed, the displacement control valve 100 fully opens one valve thereof provided for introducing refrigerant from the discharge chamber 10 into the pressure-regulating chamber 1 and fully closes the other valve thereof provided for introducing refrigerant from the pressure-regulating chamber 1 into the suction chamber 9, thereby shortening time for increasing the pressure Pc in the pressure-regulating chamber 1.

When transition to the maximum displacement operation is performed, the displacement control valve 100 fully closes the one valve thereof provided for introducing refrigerant from the discharge chamber 10 into the pressure-regulating chamber 1 and fully opens the other valve thereof provided for introducing refrigerant from the pressure-regulating chamber 1 into the suction chamber 9, so as to maximize the amount of refrigerant introduced from the pressure-regulating chamber 1 into the suction chamber 9, thereby shortening time for reducing the pressure Pc in the pressure-regulating chamber 1.

Next, the displacement control valve 100 for executing the above control will be described in detail.

Figure 7:
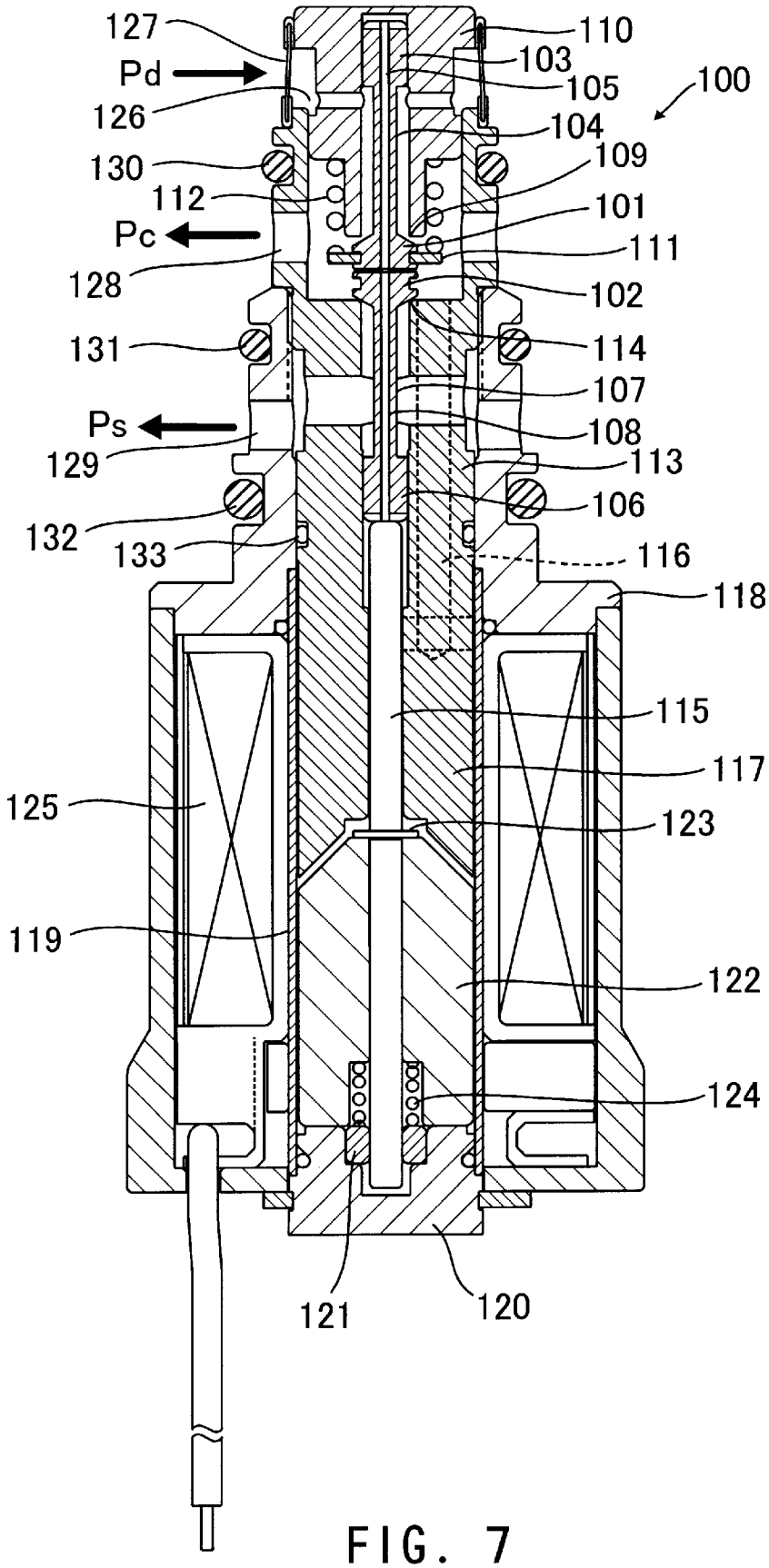
FIG. 7 is a central longitudinal cross-sectional view of a displacement control valve according to a fourth embodiment.

FIG. 7 is a central longitudinal cross-sectional view of the displacement control valve according to a fourth embodiment.

In the displacement control valve 100, the two valve elements 101, 102 are arranged opposed to each other on an identical axis such that they can move along the axis. The valve element 101 arranged at an upper location, as viewed in the figure, is integrally formed with a piston 103 forming a pressure-sensing portion and a shaft 104 connecting between the valve element 101 and the piston 103, and the one-piece member formed by the valve element 101, the shaft 104, and the piston 103 is formed with a communication hole 105 axially extending therethrough. Similarly, the valve element 102 arranged at a lower location, as viewed in the figure, is integrally formed with a piston 106 forming a pressure-sensing portion and a shaft 107 connecting between the valve element 102 and the piston 106, and the one-piece member formed by the valve element 102, the shaft 107, and the piston 106 is formed with a communication hole 108 axially extending therethrough. The valve elements 101, 102 have respective end faces thereof in abutment with each other, and the end faces are each formed with a step for allowing communication between the communication hole 105 (108) and a space where the valve elements 101 (102) is located, even when the valve elements 101, 102 are in abutment with each other.

A valve seat 109 for the valve element 101 is formed by the lower end, as viewed in the figure, of a body 110 axially slidably holding the piston 103. The valve seat 109 has an inner diameter which is slightly larger than the inner diameter of a cylinder holding the piston 103. The valve element 101 is urged in the valve-opening direction by a spring 112 arranged between an E-shaped stopper ring 111 fitted on the valve element 101 and the body 110.

The body 110 is fitted in an upper opening of a body 113. The body 113 is formed with a hole extending therethrough downward from the upper opening and having three stepwise sequentially reduced-diameter portions. An edge of opening formed in a step to a first reduced-diameter portion forms a valve seat 114 for the valve element 102. A next reduced-diameter portion forms a cylinder for axially slidably holding the piston 106, and a next reduced-diameter portion forms a guide for axially slidably holding a shaft 115 of a solenoid section. Further, the body 113 has a communication hole 116 formed therein which extends parallel with the axis thereof from the upper opening, and a lower end of the communication hole 116 has a communication hole laterally formed thereacross, for communication with an opening forming the guide of the shaft 115 and an outer periphery of the body 113. Further, the lower portion of the body 113 forms a fixed core 117 of the solenoid section.

The body 113 is screwed in the upper opening of a body 118. The upper end of a sleeve 119 is fixed to a lower opening of the body 118. The sleeve 119 has a lower end thereof closed by a stopper 120. Within the sleeve 119, the lower end of the shaft 115 is axially slidably held by a guide 121. A movable core 122 is fitted on the lower portion of the shaft 115. The movable core 122 has an upper end thereof held in abutment with a stopper ring 123 fitted on the shaft 115, and is urged upward, as viewed in the figure, by a spring 124 arranged between the guide 121 and the movable core 122 itself. Further, the outer periphery of the sleeve 119 is surrounded by a solenoid coil 125.

The body 110 has a hole communicating with a central space through which the shaft 104 extends, and the hole forms a port 126 for receiving the discharge pressure Pd from the discharge chamber 10. A strainer 127 is mounted on the port 126. The body 113 has a hole communicating with a central space formed in the upper opening portion thereof, and the hole forms a port 128 for introducing the pressure PC into the pressure-regulating chamber 1. Further, the body 113 has a hole communicating with a central space through which the shaft 107 extends and the body 118 is formed with a hole such that this hole communicates with the hole of the body 113, whereby the two holes form a port 129 communicating with the suction chamber 9 under the suction pressure Ps.

The body 113 has an O ring 130 fitted thereon at a location between the port 126 and the port 128, while the body 118 has O rings 131, 132 fitted thereon at respective locations upward and downward of the port 129. Further, portions of the body 113 and the body 118 in contact with each other, closer to the solenoid section with respect to the port 129, are sealed by an O ring 133.

Now, the relationship of pressures in the displacement control valve 100 will be described. First, the discharge pressure Pd received from the discharge chamber 10 via the port 126 is applied to the piston 103 and the valve element 101 in the opposite directions of the axis. When the effective pressure-receiving area of the valve element 101 is represented by A, and that of the piston 103 by B, a force of Pd·A acts downward, as viewed in the figure, on the valve element 101, while a force of Pd·B acts upward, as viewed in the figure, on the piston 103. Between the effective pressure-receiving area A of the valve element 101 and the effective pressure-receiving area B of the piston 103, A>B holds, and hence, after all, a force of Pd (A−B) acts on the valve element 101 and the piston 103 in the downward direction, as viewed in the figure, for opening the valve. The difference (A−B) corresponds to the effective pressure-receiving area of the conventional valve element, and conventionally, the flow rate of refrigerant is limited by the effective pressure-receiving area. According to the present invention, however, although the valve element 101 has the large effective pressure-receiving area A which can allow an increased amount of refrigerant to flow, the force acting on the valve element 101 in the valve-opening direction is limited to the small force Pd (A−B). Moreover, the pressure Pc received via the port 128 is also applied to a back pressure chamber-side face of the piston 103 via the central communication hole 105, so that the influence of the pressure Pc upon the valve element 101 is canceled. Thus, the piston 103 having a different pressure-receiving area from that of the valve element 101 is integrally formed with the valve element 101, which makes it possible to form a valve having a small pressure-receiving area, irrespective of the valve size.

Similarly, a force of Ps (A−B) acts on the valve element 102 and the piston 106 in the valve-opening direction, and the pressure Pc received via the port 128 is also applied to a back pressure chamber-side face of the piston 106 via the central communication hole 108, so that the influence of the pressure Pc upon the valve element 102 is canceled. It should be noted that the ratio between the effective pressure-receiving area of the valve element 102 and that of the piston 106 is configured to be equal to the ratio between the effective pressure-receiving area of the valve element 101 and that of the piston 103. Therefore, the valve elements 101, 102 in opposed arrangement form a differential pressure valve which operates in response to a differential pressure between the discharge pressure Pd and the suction pressure Ps.

Further, the pressure Pc received via the port 128 is also supplied via the communication hole 116 formed through the body 113 to a gap between the sleeve 119 and the fixed core 117 and the movable core 122, a space between the fixed core 117 and the movable core 122, and a gap between the movable core 122 and the stopper 120, and hence the inside of the solenoid section is filled with the pressure Pc.

In the displacement control valve 100 having the two valve structures interlocked as described above, when no control current is supplied to the solenoid coil 125 of the solenoid section, as shown in FIG. 7, the valve element 101 between the discharge pressure Pd and the pressure Pc from the pressure-regulating chamber 1 is fully open, whereas the valve element 102 between the pressure Pc and the suction pressure Ps is fully closed. Further, the movable core 122 of the solenoid section is held away from the fixed core 117 due to a balance between spring load of the spring 112 and that the spring 124. Therefore, the value of the pressure Pc in the pressure-regulating chamber 1 is held close to the value of the discharge pressure Pd, and hence the difference between pressures applied to the respective opposite faces of the piston 6 is minimized, whereby the wobble plate 4 is inclined at an inclination angle which minimizes the length of stroke of the piston 6, thus controlling the variable displacement compressor to the minimum displacement operation.

When a maximum control current is supplied to the solenoid coil 125 of the solenoid section, the movable core 122 is attracted toward the fixed core 117 and moved upward, as viewed in the figure, whereby the valve element 101 between the discharge pressure Pd and the pressure Pc from the pressure-regulating chamber 1 is fully closed, and the valve element 102 between the pressure Pc and the suction pressure Ps is fully opened. As a result, in addition to refrigerant being introduced from the pressure-regulating chamber 1 into the suction chamber 9 via the orifice 13, refrigerant flows from the port 128 communicated with the pressure-regulating chamber 1, and passes between the valve element 102 and the valve seat 114 therefor, followed by being introduced into the suction chamber 9 via the port 129. Since the amount of refrigerant introduced from the pressure-regulating chamber 1 into the suction chamber 9 is increased, it is possible to increase a speed at which the operating displacement is maximized.

During execution of normal control in which a predetermined control current is supplied to the solenoid coil 125 of the solenoid section, the movable core 122 is attracted toward the fixed core 117 and moved upward, as viewed in the figure, according to the magnitude of the control current. As a result, the valve element 102 is opened from its closed state only when the differential pressure between the discharge pressure Pd and the suction pressure Ps exceeds a predetermined reference value. In short, during execution of the normal control, the displacement control valve 100 operates as a differential pressure valve.

Figure 8:
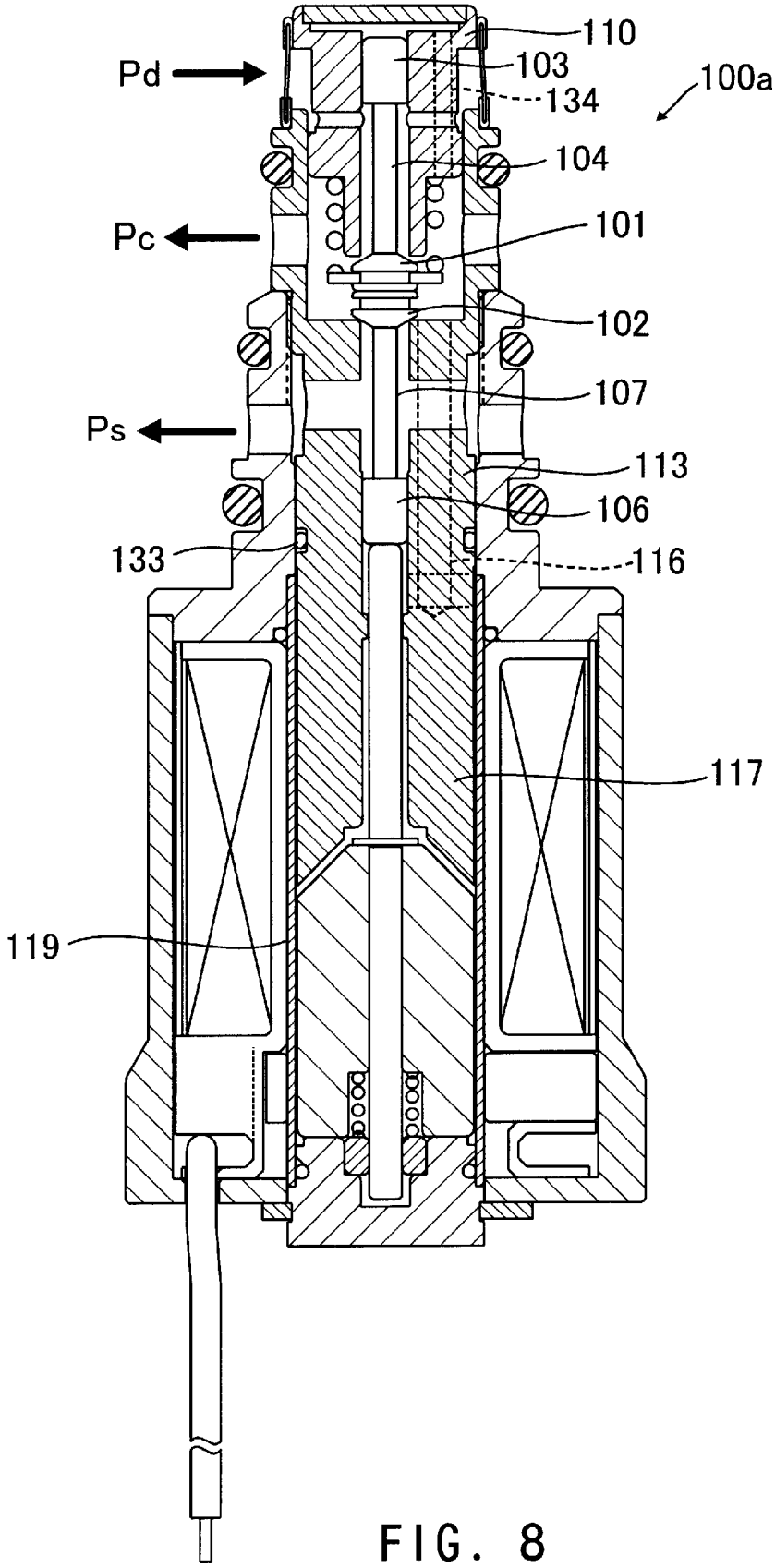
FIG. 8 is a central longitudinal cross-sectional view of a displacement control valve according to a fifth embodiment.

FIG. 8 is a central longitudinal cross-sectional view of a displacement control valve according to a fifth embodiment. In FIG. 8, component parts and elements similar to those appearing in FIG. 7 are designated by identical reference numerals, and detailed description thereof is omitted.

The displacement control valve 100*a* according to the fifth embodiment has a different structure for canceling the influence of the pressure Pc upon valve elements 101, 102, from that of the FIG. 7 displacement control valve 100. shown in FIG. 7. More specifically, a one-piece member formed by the valve element 101, a piston 103 and a shaft 104, and a one-piece member formed by the valve element 102, a piston 103 and a shaft 107 are each formed as a solid member having no communication hole axially extending therethrough. On the other hand, a body 110 is formed with a communication hole 134 for introducing the pressure Pc into a back pressure chamber of the piston 103. Further, a body 113 is formed with a communication hole 116 opening into a space forming a back pressure chamber of the piston 106 and a gap between respective portions of a fixed core 117 and a sleeve 119 closer to the solenoid section with respect to an O ring 133. The displacement control valve 100*a* constructed as above operates similarly to the displacement control valve 100 of the fourth embodiment.

As described heretofore, the displacement control valve according to the present invention is comprised of first and second valve elements which are operated in an interlocked fashion for opening and closing passages communicating, respectively, between a discharge chamber and a pressure-regulating chamber and between the pressure-regulating chamber and a suction chamber, and a solenoid section which applies a solenoid force corresponding to a predetermined differential pressure to the first and second valve elements. This enables control to the minimum operating displacement in which introduction of refrigerant from the pressure-regulating chamber to the suction chamber is inhibited and refrigerant is introduced at a maximum flow rate from the discharge chamber to the pressure-regulating chamber as well as control to the -maximum operating displacement in which introduction of refrigerant from the discharge chamber to the pressure-regulating chamber is inhibited and refrigerant is introduced at a maximum flow rate from the pressure-regulating chamber to the suction chamber, thereby making it possible to sharply shorten time for transition between operating capacities.

Further, in the present invention, the first and second valve elements are integrally formed with a central shaft forming a pressure-sensing portion having a smaller pressure-receiving area than those of the first and second valve elements. This makes it possible to make the pressure-receiving areas of the respective first and second valve elements substantially equal to a difference in pressure-receiving area between the first or second valve element and the central shaft, and hence even if the size of the valve is increased so as to increase the amount of refrigerant permitted to flow during transition between operating capacities, the respective substantial pressure-receiving areas of the first and second valve elements can be reduced, irrespective of the valve size, by reducing the difference in pressure-receiving area between each of the first and second valve elements and the central shaft. Therefore, it is not required to increase the solenoid force for controlling the first and second valve elements, which makes it possible to reduce the size of a solenoid section.

The foregoing is considered as illustrative only of the principles of the present invention. Further, since numerous modifications and changes will readily occur to those skilled in the art, it is not desired to limit the invention to the exact construction and applications shown and described, and accordingly, all suitable modifications and equivalents may be regarded as falling within the scope of the invention in the appended claims and their equivalents.

What is claimed is:

1. A variable displacement compressor including a wobble member arranged in a pressure-regulating chamber formed airtightly, such that an inclination angle of the wobble member can be changed with respect to a rotational shaft, and driven by rotation of the rotational shaft for wobbling motion, and pistons each connected to the wobble member for performing reciprocating motion in a direction parallel to the rotational shaft in accordance with the wobbling motion of the wobble member, to thereby draw refrigerant from a suction chamber into a cylinder, compress the refrigerant, and deliver the compressed refrigerant from the cylinder to a discharge chamber, characterized in that a flow rate of the refrigerant flowing in a first refrigerant passage extending from the discharge chamber to the pressure-regulating chamber and a flow rate of the refrigerant flowing in a second refrigerant passage extending from the pressure-regulating chamber to the suction chamber are controlled in an interlocked fashion such that the first refrigerant passage and the second refrigerant passage are opened and closed, based on a change in a differential pressure between pressure in the suction chamber and pressure in the discharge chamber.

2. The variable displacement compressor according to claim 1, wherein the first refrigerant passage extends in parallel with a first orifice for introducing the refrigerant from the discharge chamber into the pressure-regulating chamber, while the second refrigerant passage extends in parallel with a second orifice for introducing the refrigerant from the pressure-regulating chamber to the suction chamber.

3. The variable displacement compressor according to claim 1, wherein when the compressor is operated with a minimum operating displacement, the first refrigerant passage is fully opened, and the second refrigerant passage fully closed, whereas when the compressor is operated with a maximum operating displacement, the first refrigerant passage is fully closed, and the second refrigerant passage fully opened.

4. A displacement control valve for a variable displacement compressor, for controlling an amount of refrigerant introduced from a discharge chamber into a pressure-regulating chamber, such that a differential pressure between pressure in the suction chamber and pressure in the discharge chamber are maintained at a predetermined differential pressure, to thereby change an amount of the refrigerant discharged from the variable displacement compressor, characterized by comprising:

first and second valve elements operated in an interlocked fashion for opening and closing a refrigerant passage extending between the discharge chamber and the pressure-regulating chamber and a refrigerant passage extending between the pressure-regulating chamber and the suction chamber, respectively; and a solenoid section for applying a solenoid force corresponding to the predetermined differential pressure to the first and second valve elements.

5. The displacement control valve for a variable displacement compressor, according to claim 4, wherein a central shaft axially movably held by a holder fluidly separating the first valve element and the second valve element from each other and having a smaller pressure-receiving area than the first and second valve elements has opposite ends one of which has the first valve element fixed thereto via a shaft thinner than the central shaft and the other of which has the second valve element in abutment therewith via a shaft thinner than the central shaft, with discharge pressure from the discharge chamber being applied between the first valve element and the central shaft, and suction pressure from the suction chamber being applied between the second valve element and the central shaft, and wherein at the same time, a downstream side of the first valve element and a upstream side of the second valve element are communicated with the pressure-regulating chamber by respective two passages independent of each other.

6. The displacement control valve for a variable displacement compressor, according to claim 5, wherein the solenoid section is arranged toward the first valve element, and a shaft of the solenoid section for applying the solenoid force to the first valve element is in abutment with the first valve element.

7. The displacement control valve for a variable displacement compressor, according to claim 6, wherein the first valve element, the central shaft, and the shafts thinner than the central shaft, which are positioned on the respective opposite ends of the central shaft are integrally formed with each other, the second valve element being held in abutment with an end of the thinner shaft positioned in the opposite side of the first valve element.

8. The displacement control valve for a variable displacement compressor, according to claim 4, wherein the first and second valve elements are arranged opposed to each other on an identical axis in an axially movable fashion, and are integrally formed, respectively, with first and second pistons each having a smaller pressure-receiving area than the first and second valve elements, via first and second shafts axially extending outward from the first and second valve elements, respectively, the displacement control valve including a holder fluidly separating the first valve element and the second valve element from each other and a transmission shaft axially slidably held by the holder and sandwiched between the first valve element and the second valve element, for axially moving the first valve element and the second valve element in an interlocking fashion, with discharge pressure from the discharge chamber being applied between the first valve element and the first piston, and suction pressure from the suction chamber being applied between the second valve element and the second piston, and wherein at the same time, a downstream side of the first valve element and a upstream side of the second valve element are communicated with the pressure-regulating chamber by respective two passages independent of each other.

9. The displacement control valve for a variable displacement compressor, according to claim 8, including a first communication hole formed between a back pressure chamber of the first piston and the downstream side of the first valve element, for introducing pressure from the pressure-regulating chamber, and a second communication hole formed between a back pressure chamber of the second piston and the upstream side of the second valve element, for introducing pressure from the pressure-regulating chamber.

10. The displacement control valve for a variable displacement compressor, according to claim 9, wherein the first communication hole is formed along an axis of the first valve element, the first shaft, and the first piston, which are integrally formed with each other, and the second communication hole is formed along an axis of the second valve element, the second shaft, and the second piston, which are integrally formed with each other, and wherein portions of the first and second valve elements in abutment with the transmission shaft are communicated with the first and second communication holes, respectively.

11. The displacement control valve for a variable displacement compressor, according to claim 9, wherein the first communication hole is formed through a first body formed with a valve seat for the first valve element, while the second communication hole is formed through a second body formed with a valve seat for the second valve element.

12. The displacement control valve for a variable displacement compressor, according to claim 8, wherein a body having a valve seat for the second valve element and a cylinder slidably holding the second piston is integrally formed with a fixed core of the solenoid section.

13. The displacement control valve for a variable displacement compressor, according to claim 4, wherein the first and second valve elements are arranged opposed to each other on an identical axis in an axial direction movably, and are integrally formed, respectively, with first and second pistons each having a smaller pressure-receiving area than the first and second valve elements, via first and second shafts axially extending outward from the first and second valve elements, respectively, with discharge pressure from the discharge chamber being applied between the first valve element and the first piston, suction pressure from the suction chamber being applied between the second valve element and the second piston, and pressure from the pressure-regulating chamber being applied to portions of the first and second valve elements in abutment with each other.

14. The displacement control valve for a variable displacement compressor, according to claim 13, including first and second communication holes for introducing the pressure from the pressure-regulating chamber into back pressure chambers of the first and second pistons, respectively.

15. The displacement control valve for a variable displacement compressor, according to claim 14, wherein the first communication hole is formed along an axis of the first valve element, the first shaft, and the first piston, which are integrally formed with each other, and the second communication hole is formed along an axis of the second valve element, the second shaft, and the second piston, which are integrally formed with each other, and wherein the portions of the first and second valve elements in abutment with each other are communicated with the first and second communication holes.

16. The displacement control valve for a variable displacement compressor, according to claim 15, wherein the first communication hole is formed through a first body formed with a valve seat for the first valve element, while the second communication hole is formed through a second body formed with a valve seat for the second valve element.

17. The displacement control valve for a variable displacement compressor, according to claim 15, wherein a body having a valve seat for the second valve element and a cylinder slidably holding the second piston is integrally formed with a fixed core of the solenoid section.

18. The displacement control valve for a variable displacement compressor, according to claim 4, wherein when no control current is supplied to the solenoid section, the second valve element between the pressure-regulating chamber and the suction chamber is closed, and the first valve element between the discharge chamber and the pressure-regulating chamber is opened to a maximum valve travel, whereby operating displacement of the variable displacement compressor is controlled to a minimum, while when a maximum control current is supplied to the solenoid section, the second valve element between the pressure-regulating chamber and the suction chamber is opened to a maximum valve travel, and the first valve element between the discharge chamber and the pressure-regulating chamber is closed, whereby the operating displacement of the variable displacement compressor is controlled to a maximum.

19. The displacement control valve for a variable displacement compressor, according to claim 4, applied to a variable displacement compressor for use in a refrigeration cycle causing the refrigerant to perform refrigerating operation in a supercritical region in which a temperature of the refrigerant is above a supercritical temperature thereof.

* * * * *